United States Patent [19]

Souchon

[11] 3,954,447

[45] May 4, 1976

[54] PROCESS FOR THE PROTECTION OF A METAL INGOT AGAINST OXIDATION

[75] Inventor: Guy Souchon, Cierp-Gaud, France

[73] Assignee: Societe Francaise D'Electrometallurgie, Paris, France

[22] Filed: June 3, 1974

[21] Appl. No.: 475,424

[30] Foreign Application Priority Data

June 1, 1973 Luxemburg ..... 67716

[52] U.S. Cl. ..... 75/67 R; 164/123

[51] Int. Cl.[2] ..... C22B 29/00

[58] Field of Search..... 75/67 R, 67 A; 29/187; 164/123, 42, 102

[56] References Cited

UNITED STATES PATENTS

| | | | |
|---|---|---|---|
| 1,935,591 | 11/1933 | Lacell | 164/42 |
| 2,235,199 | 3/1941 | Chace | 164/102 |
| 3,717,457 | 2/1973 | Jarysta | 75/130 A |

FOREIGN PATENTS OR APPLICATIONS

| | | | |
|---|---|---|---|
| 104,185 | 10/1937 | Australia | 75/67 |

*Primary Examiner*—M. J. Andrews

[57] ABSTRACT

A process for reducing the degree of oxidation of a metal obtained by a production or purification operation wherein the metal is converted to the vapor state and then condensed to the liquid form in a vessel the lower part of which forms a crucible or pot in which it solidifes and in which a fusible flux is added to the metal in the crucible with a view to reducing the degree of oxidation, whereby the flux is added after previously being melted and the molten flux caused to penetrate into the void formed by contraction between the ingot and the inner wall of the crucible or pot.

4 Claims, 4 Drawing Figures

PROCESS FOR THE PROTECTION OF A METAL INGOT AGAINST OXIDATION

Figure 1:
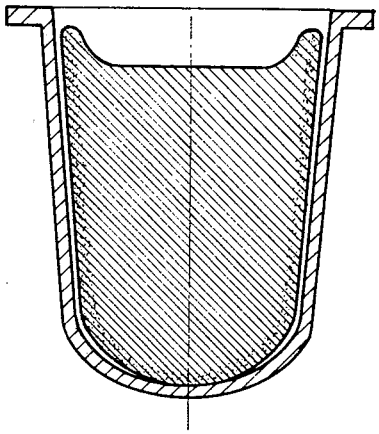

The invention relates to an improvement in processes for the production or treatment of magnesium and other readily oxidized metals.

It is known that metals which are solid at normal temperatures may be prepared or purified by causing them to pass into the vapor state in a suitable vessel and subsequently causing them to condense to the solid state in a separate vessel communicating with the first vessel. In the absence of special precautions, the metal is obtained in a very finely divided form due to its passing directly from the gaseous to the solid state and, if the metal is readily oxidized, it cannot be brought directly into contact with air because of the accompanying risk of ignition.

It has been proposed to condense the metal to the liquid state in a suitable receptacle or vessel at a suitably chosen temperature and pressure and thereafter to cause the metal to solidify (French Pat. Nos. 977,048 and 978,508). However, the industrial method employed consists in condensing the metal on a surface which has been brought to a temperature such that the metal condenses to the liquid state and allowing the metal to flow over the surface and fall into a crucible or pot, at a lower temperature, in which it is then allowed to solidify (French Pat. Nos. 987,046, 1,037,663, 1,052,513 and additional specification No. 63,774).

This process can be used to obtain a solid ingot of metal which fills the bottom of a crucible or pot which forms the bottom of and may be detached from the condenser.

Upon completion of the above operation, the crucible or pot is removed and the metal recovered and then normally remelted for the purposes of refining and casting into smaller ingots.

With a view to obviating the oxidation of the surface of the ingot while the latter is cooling in air, the normal practice is to cover the metal with a uniform layer of a flux consisting mainly of chlorides, in the form of a finely divided powder, which melts on contact with the hot melt thus preventing contact between the metal and air.

It has however been found that this affords only incomplete protection and that parts of the metal are oxidized to variable extents.

This is clearly reflected in the fact that the weights of "slag" formed by the oxidation of the metal and its impurities and which is retained by the flux vary substantially from one operation to the other, thus pointing to the occurrence of oxidation reactions which have not been brought fully under control.

The process, according to this invention, enables such unwanted oxidation to be reduced very considerably, thus increasing the quantity of metal produced while reducing the risk of ignition.

This invention is based on the following observations:

The ingot of metal is not uniform but comprises an outer layer several centimeters thick in which the metal is in a very finely divided state. This layer probably forms directly from the vapor phase during the commencement of the operation of the furnace.

When the crucible or pot filled with metal is disconnected from the condenser, upon completion of the operation, for transfer to the foundry for remelting and refining, the outer layer described, which will have withdrawn slightly from the wall of the crucible or pot due to contraction, comes into contact with air and the divided metal undergoes oxidation.

When the crucible or pot is introduced into the foundry furnace and heated to melt the metal contained therein, for the purposes of refining and casting, the wall of the crucible or pot expands, thus leading to a commensurate increase in the annular space between the pot and the block of solid metal. The divided metal composing the outer layer will thus be in contact with air and will moreover be heated by radiation from the red hot wall of the crucible or pot. This conjunction of circumstances will therefore tend to cause the combustion of the metal in the outer layer.

The process of this invention consists of pouring onto the ingot a flux which has previously been melted and causing this to penetrate into the annular space between the ingot and the crucible or pot.

In this way, the outer and upper surfaces of the ingot are protected against the ingress of air. Additionally, the molten flux transfers heat to the metal whereas the flux introduced cold in the prior art absorbs heat. The result is to reduce the consequences of the void between the crucible and ingot on reheating and thus reduce the degree of oxidation observed where the said void is incompletely filled.

Figure 2:
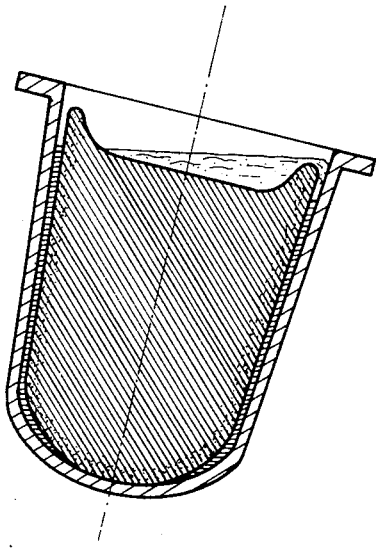
Figure 3:
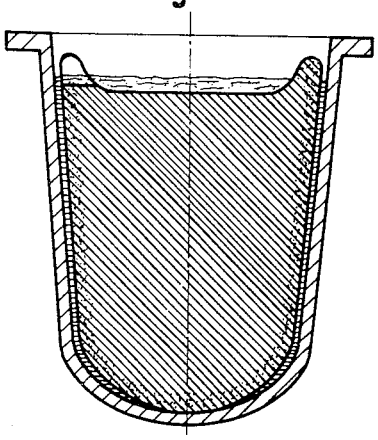
Figure 4:
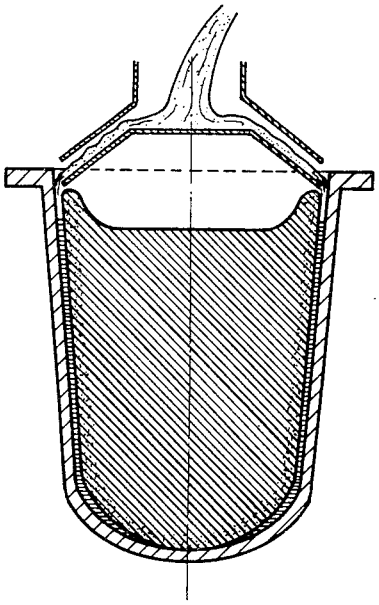

FIGS. 1–4 are sectional views which schematically illustrate the voids in FIG. 1 and various techniques for filling the voids in accordance with the practice of this invention in FIGS. 2–4.

A difficulty effecting the penetration of the molten flux into the space between the crucible and ingot arises from the fact that, as a result of contraction, the upper surface of the ingot assumes a concave form with a raised rim (FIG. 1). This being so, the molten flux tends to collect towards the center of the ingot and does not attain the outer surface.

A simple remedy is to pour the molten flux into the metal and then raise and tilt the crucible slightly so as to cause the flux to flow over the rim of the ingot (FIG. 2). While this method does not involve the use of any additional equipment, the void between the ingot and the crucible is incompletely filled at the top.

A further method is to notch or drill a hole in the rim in order to enable the flux to flow to the outer surface (FIG. 3) thus improving the filling of the space between the ingot and crucible.

The preferred method is to use a multi-way spout resting on the edge of the crucible or pot (FIG. 4). The space between the ingot and pot is then filld before, or at the same time that the central portion and the ingot is completely protected.

Needless to say, the flux employed should be in the molten state to insure good wetting of the metal. Preferably, the flux used will have the same composition as that used for subsequent refining where this latter stage is to follow the production and/or purification of the metal. In the case of magnesium, the preferred fluxes consist mainly of magnesium chloride, potassium chloride and sodium chloride.

EXAMPLE

Two series of operations were carried out using the "Magnetherm" process described in French Pat. No. 1,194,556, wherein magnesium oxide is reduced by ferrosilicon at high temperature and reduced pressure and the magnesium produced is recovered as vapor in a condenser in which it condenses to the liquid state and then flows into a crucible or pot in which it solidifies.

Once the crucible, which contains 5 to 7 tons of metal, is full, the process is arrested and the crucible or pot removed, allowed to cool, and transferred to the cast house where the metal is remelted in a furnace.

In the first series of operations, the metal in the crucible was covered in accordance with the prior art with a layer of solid powdered flux having the composition 42% magnesium chloride, 44% potassium chloride, 10% sodium chloride, 2% magnesium oxide and 2% water.

In the second series of operations, a flux of the same composition was introduced in accordance with the invention in the molten form using a three-way spout to distribute the flux around the inside of the crucible.

In each case, the average weight of slag produced in the course of the production and cooling of the metal and subsequent remelting and refining operations was estimated by difference between the weight of residue remaining in the crucible after remelting and casting the metal and the weight of flux added.

In the first series, this weight was 1,652 kg.

In the second series it was only 612 kg, i.e. a reduction of 1,040 kg, which corresponds to some 600 kg of magnesium. This evaluation was based on thirty operations.

The saving realized thus represents some 10% of the metal produced.

I claim:

1. A method to reduce the degree of oxidation of an ingot of a metal comprising magnesium obtained by a production or purification operation by converting the metal to a vapor state, condensing the vapor to the liquid form in a vessel the lower portion of which forms a crucible in which the liquid solidifies as an ingot with the formation of space by contraction between the ingot and the inner walls of the crucible, adding a fusable flux to the metal in the crucible with a view towards reducing the degree of oxidation, comprising causing a molten flux to flow into the said space between the crucible walls and the adjacent surfaces of the ingot and over the top of the ingot.

2. The method as claimed in claim 1 in which the ingot is formed with a concave top surface and the flux is introduced onto the top surface and which includes the step of inclining the crucible to cause the liquid flux to overflow the edges of the ingot into the said space.

3. The method as claimed in claim 1 in which the ingot is formed with a concave top surface and the flux is introduced onto the top surface of the ingot, said ingot being formed with one or more passages extending from the concave portion of the top surface to the said space, at a level below the upper edge of the ingot, to enable liquid flux to flow from the concave portion of the ingot to the said space.

4. The method as claimed in claim 1 in which the liquid flux is guided by a distributor over the top of the ingot to the entry into said space for flow of the liquid flux directly into said space.

* * * * *